US009732595B2

(12) United States Patent
Wright

(10) Patent No.: US 9,732,595 B2
(45) Date of Patent: Aug. 15, 2017

(54) FLUID CONNECTOR ASSEMBLY WITH AUTOMATIC FLOW SHUT-OFF AND METHOD USABLE FOR ESTABLISHING A FLUID CONNECTION

(71) Applicant: David C. Wright, Spring, TX (US)

(72) Inventor: David C. Wright, Spring, TX (US)

(73) Assignee: Wright's Well Control Services, LLC, Spring, TX (US)

( * ) Notice: Subject to any disclaimer, the term of this patent is extended or adjusted under 35 U.S.C. 154(b) by 507 days.

(21) Appl. No.: 14/087,892

(22) Filed: Nov. 22, 2013

(65) Prior Publication Data

US 2015/0136423 A1 May 21, 2015

Related U.S. Application Data

(63) Continuation-in-part of application No. 14/083,754, filed on Nov. 19, 2013, now Pat. No. 9,309,739.

(51) Int. Cl.

| | |
|---|---|
| ***E21B 17/02*** | (2006.01) |
| ***E21B 33/038*** | (2006.01) |
| ***E21B 43/013*** | (2006.01) |

(52) U.S. Cl.

CPC ..... *E21B 43/013* (2013.01); *E21B 17/02* (2013.01)

(58) Field of Classification Search

CPC ..... E21B 17/02; E21B 17/046; E21B 33/038; E21B 43/013

USPC ..... 166/344

See application file for complete search history.

(56) References Cited

U.S. PATENT DOCUMENTS

| | | | | |
|---|---|---|---|---|
| 2,457,251 | A * | 12/1948 | Main, Jr. | F16L 37/107 137/599.02 |
| 3,077,330 | A | 2/1963 | Lamphear | |
| 3,096,999 | A | 7/1963 | Ahlstone et al. | |
| 3,439,944 | A * | 4/1969 | Leutenegger | F16L 37/0842 285/321 |
| 3,551,005 | A * | 12/1970 | Brun | E21B 33/038 166/341 |
| 3,773,360 | A * | 11/1973 | Timbers | F16L 37/088 285/307 |
| 4,351,351 | A * | 9/1982 | Flory | F16L 55/1015 137/614.03 |
| 4,361,165 | A * | 11/1982 | Flory | F16K 17/40 137/614.02 |
| 4,477,105 | A | 10/1984 | Wittman et al. | |

(Continued)

FOREIGN PATENT DOCUMENTS

GB 2012140443 A1 10/2012

*Primary Examiner* — Matthew R Buck

(57) ABSTRACT

Embodiments usable within the scope of the present disclosure relate generally to a connector apparatus and methods usable to securely and repeatedly connect a sub-sea fluid conduit to another fluid conduit or well equipment, such as a manifold, a wellhead, a BOP, or other associated items. The disclosed embodiments further relate to systems and methods usable to remotely disconnect the fluid conduit and automatically shut off fluid flow therethrough. The male connector includes a flow control valve adapted to open upon connection with a female connector and to close upon disconnection from the female connector. The female connector is adapted to actuate the flow control valve of the male connector to the open position. The male connector includes a biasing member that actuates the flow control valve of the male connector to the closed position.

14 Claims, 7 Drawing Sheets

(56) References Cited

U.S. PATENT DOCUMENTS 4,637,470 A 1/1987 Weathers et al.
5,072,755 A * 12/1991 Wilcox ..... E21B 33/038 137/614.03
5,320,395 A 6/1994 Gernhardt et al.
5,456,501 A 10/1995 Reaux
5,794,701 A 8/1998 Cunningham et al.
5,829,480 A * 11/1998 Smith, III ..... F16L 37/086 137/614
5,899,228 A * 5/1999 Smith, III ..... F16L 29/04 137/614.04
5,934,709 A * 8/1999 Morrison ..... F16L 37/0842 285/315
6,009,950 A * 1/2000 Cunningham ..... E21B 33/038 166/344
6,106,026 A * 8/2000 Smith, III ..... F16L 1/26 285/84
6,227,245 B1 * 5/2001 Smith, III ..... E21B 33/038 137/614.04
6,336,238 B1 1/2002 Tarlton
6,626,207 B1 * 9/2003 Smith, III ..... F16L 37/32 137/614.03
7,275,563 B2 * 10/2007 Tiberghien ..... F16L 29/04 137/614.04
7,311,035 B2 12/2007 Reynolds
7,380,835 B2 6/2008 McCoy et al.
7,467,799 B1 12/2008 Tarlton
7,469,933 B2 * 12/2008 Swift ..... F16L 37/0847 285/313
7,533,907 B2 * 5/2009 Swift ..... F16L 37/002 285/321
7,849,926 B2 * 12/2010 Inderberg ..... E21B 17/06 137/68.14
7,906,727 B2 3/2011 Bradley
8,087,465 B2 * 1/2012 Huang ..... E21B 33/037 166/339
8,469,107 B2 * 6/2013 O'Malley ..... E21B 23/004 166/330
8,662,181 B2 * 3/2014 Hamblin ..... E21B 41/0007 166/338
8,814,219 B2 * 8/2014 Hennemann ..... F16L 37/088 285/319
8,939,214 B2 * 1/2015 Litherland ..... E21B 17/015 166/343
2007/0272417 A1 11/2007 Benson
2008/0100063 A1 5/2008 Benson et al.
2012/0328371 A1 * 12/2012 Munstereifel ..... F16L 1/26 405/169
2013/0092248 A1 4/2013 June

* cited by examiner

FLUID CONNECTOR ASSEMBLY WITH AUTOMATIC FLOW SHUT-OFF AND METHOD USABLE FOR ESTABLISHING A FLUID CONNECTION

CROSS-REFERENCE TO RELATED APPLICATIONS

The present application is a continuation-in-part application claiming priority to the co-pending U.S. Patent Application having the Ser. No. 14/083,754, entitled "STAB CONNECTOR ASSEMBLY AND METHODS USABLE FOR ESTABLISHING A FLUID CONNECTION," filed on Nov. 19, 2013, the entirety of which is incorporated by reference herein.

FIELD

Embodiments usable within the scope of the present disclosure relate, generally, to connector assemblies and to methods usable to securely connect and disconnect sub-sea fluid conduits. More particularly, to male connectors adapted to securely engage female connectors and remotely disengage therefrom, wherein the male and female fluid connectors are adapted to quickly and automatically shut off fluid flow therethrough, as the male and female connectors disengage in the course of regular operations or during emergencies.

BACKGROUND

Connection of well equipment usually requires mating of corresponding flanges and bolting of the flanges. Conventional methods for connecting or disconnecting well servicing equipment require the use of an ROV or a diver to bolt or unbolt the flanges. This process is time consuming and expensive, especially when performed in a subsea environment. Remotely actuated connectors can be used to eliminate manual connection operations, such as those performed by divers and ROVs, when connecting well servicing equipment to and from a wellhead or other items of well equipment, resulting in a more efficient and less expensive process.

However, conventional remotely actuated connectors are complex and typically contain locking mechanisms embedded within the connector bodies and/or covered by framing. Performing maintenance on these subsea connectors is difficult, often requiring retrieval of entire equipment stacks to the surface. A need therefore exists for subsea conduit connectors that are not susceptible to contamination, are easy to maintain, and provide the ability to reliably, securely, and remotely form connections for extended periods of time, and to reliably and remotely disconnect from an object when desired.

Typical remotely actuated fluid connectors do not contain integral flow control valves designed to automatically shut off fluid flow through the connector. During emergencies and/or rapid disconnection of a conventional fluid connector, fluids remaining in the conduit portion located upwell of the connector may leak into the water causing environmental pollution. A need therefore exists for male and female fluid conduit connectors that will automatically shut off fluid flow therethrough when disconnected.

Special considerations must be taken when a connector is used in association with long fluid conduits, as the conduits are subjected to forces generated by waves, currents, and other subsea conditions. These forces are transmitted to the connector assembly, causing it to loosen, allowing fluids to breach the seals. Conventional locking mechanisms, especially those involving numerous moving parts, have an increased tendency to loosen after a lengthy period of use, especially when repeatedly subjected to large bending forces. Thus, a need also exists for fluid conduit connector assembly that can withstand strong bending forces caused by fluid conduit movements.

SUMMARY

Embodiments usable within the scope of the present disclosure include a fluid connector assembly with automatic flow shut-off.

The fluid connector assembly comprises a first connector having an elongate body and an axial bore extending therethrough and a second connector having an elongate body and an axial bore extending therethrough, wherein the first connector and the second connector are adapted to engage. The engagement between the first connector and the second connector joins the axial bore of the first connector with the axial bore of the second connector to define a flowpath for communicating a medium. The first connector assembly can further comprise a flow control valve adapted to selectively open and close the axial bore of the first connector, wherein the flow control valve is adapted to actuate to an open position by the second connector as the first connector and the second connector engage. The flow control valve can automatically actuate to a closed position as the first connector and the second connector disengage.

Another embodiment of the fluid connector usable within the scope of the present disclosure comprises a first connector having an elongate body and an axial bore extending therethrough and a second connector having an elongate body and an axial bore extending therethrough, wherein the first connector and the second connector are adapted to engage. Engagement between the first connector and the second connector joins the axial bore of the first connector with the axial bore of the second connector to define a flowpath for communicating a fluid. In an embodiment, the first connector can comprise a flow control valve adapted to selectively open and close the axial bore of the first connector. The second connector can comprise at a flow control valve adapted to selectively open and close the axial bore of the second connector. The flow control valve of the first connector and the flow control valve of the second connector can be adapted to actuate to a closed position as the first connector and the second connector disengage.

Embodiments usable within the scope of the present disclosure include methods for establishing and terminating a fluid connection with a fluid connector assembly. The method includes the step of engaging a first connector with a second connector, thereby joining an axial bore of the first connector with an axial bore of the second connector to define a flowpath for communicating a fluid. The method also includes the step of disengaging the first connector from the second connector. The step of disengaging the first connector from the second connector can comprise the steps of unlocking the first connector from the second connector, retracting a male stab from a female receptacle, disengaging the second connector from a flow control valve positioned within the first connector, and closing the flow control valve positioned within the first connector.

BRIEF DESCRIPTION OF THE DRAWINGS

In the detailed description of various embodiments usable within the scope of the present disclosure, presented below, reference is made to the accompanying drawings, in which.

DETAILED DESCRIPTION OF THE EMBODIMENTS

Before describing selected embodiments of the present disclosure in detail, it is to be understood that the present invention is not limited to the particular embodiments described herein. The disclosure and description herein is illustrative and explanatory of one or more presently preferred embodiments and variations thereof, and it will be appreciated by those skilled in the art that various changes in the design, organization, order of operation, means of operation, equipment structures and location, methodology, and use of mechanical equivalents may be made without departing from the spirit of the invention.

As well, it should be understood that the drawings are intended to illustrate and plainly disclose presently preferred embodiments to one of skill in the art, but are not intended to be manufacturing level drawings or renditions of final products and may include simplified conceptual views as desired for easier and quicker understanding or explanation. As well, the relative size and arrangement of the components may differ from that shown and still operate within the spirit of the invention.

Moreover, it will be understood that various directions such as "upper," "lower," "bottom," "top," "left," "right," and so forth are made only with respect to explanation in conjunction with the drawings, and that the components may be oriented differently, for instance, during transportation and manufacturing as well as operation. Because many varying and different embodiments may be made within the scope of the concepts herein taught, and because many modifications may be made in the embodiments described herein, it is to be understood that the details herein are to be interpreted as illustrative and non-limiting.

Embodiments usable within the scope of the present disclosure relate generally to a connector assembly and methods usable to securely and repeatedly connect sub-sea fluid conduits or to connect a fluid conduit to subsea equipment, such as a manifold, a wellhead, a BOP, or other items. The disclosed embodiments further relate to systems and methods usable to connect and/or disconnect a fluid connector assembly and to automatically and rapidly shut off fluid flow through the male and/or the female connectors during disconnection.

Figure 1A:
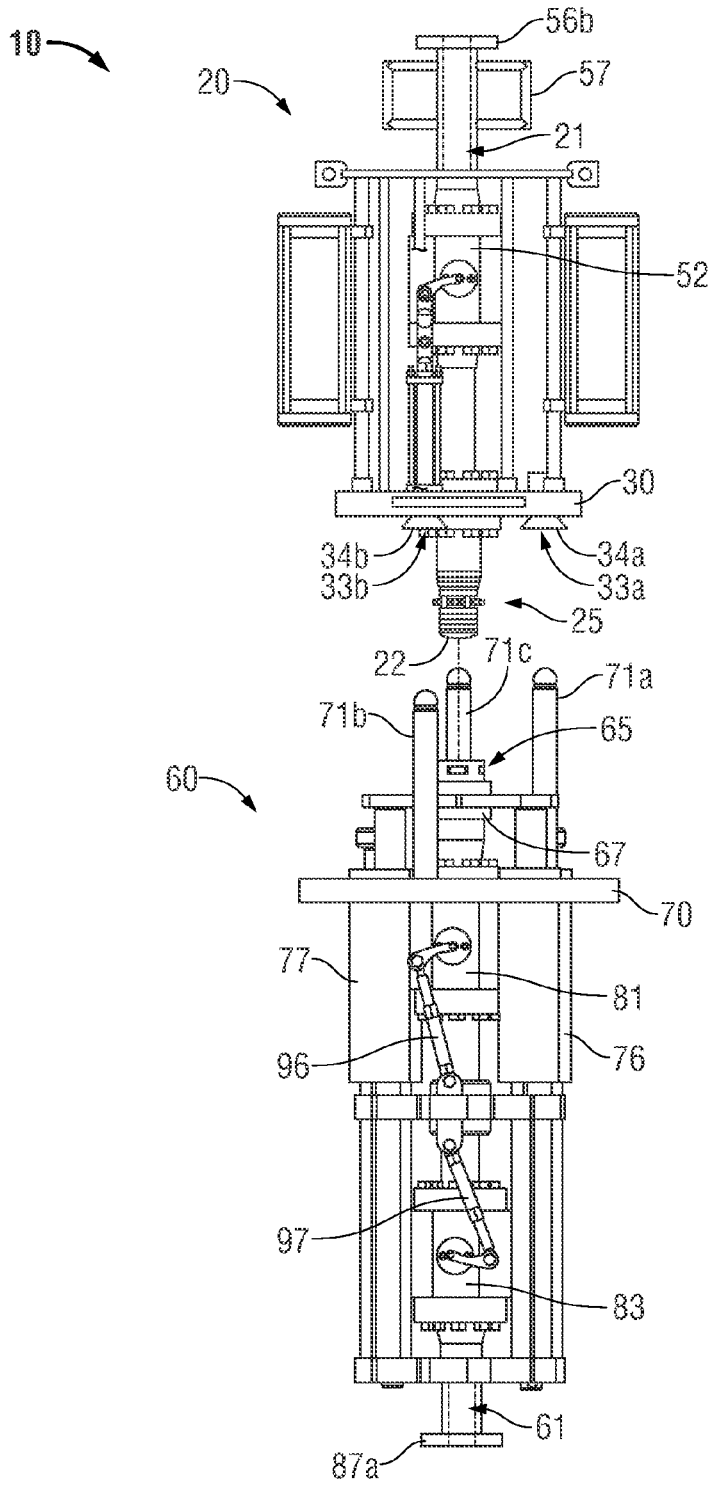
FIG. 1A depicts a side view of an embodiment of an unengaged connector apparatus usable within the scope of the present disclosure.
Figure 1B:
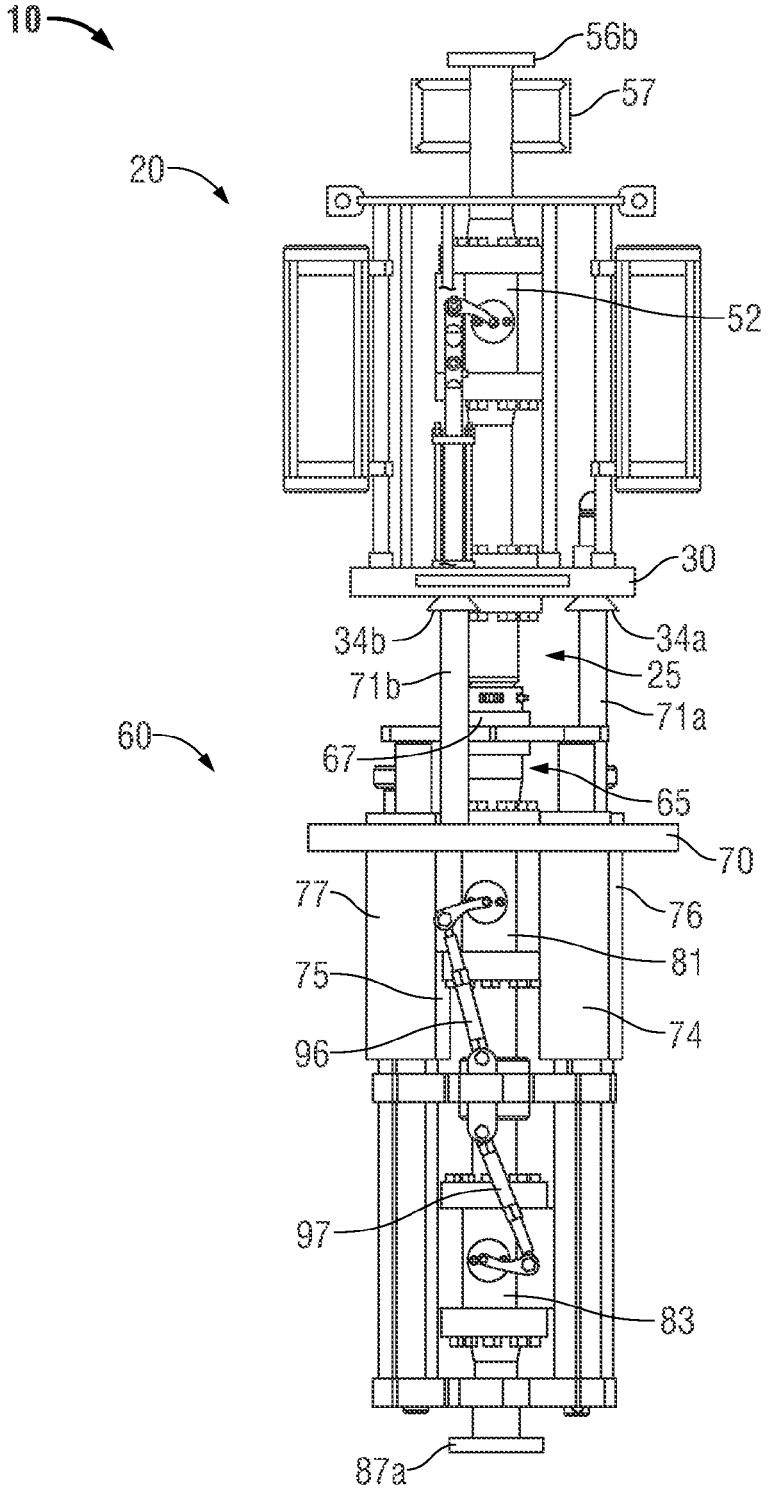
FIG. 1B depicts a side view of an embodiment of an engaged connector apparatus usable within the scope of the present disclosure.

Referring now to FIGS. 1A and 1B, depicting side views of an embodiment of a connector apparatus (10) usable within the scope of the present disclosure. The depicted connector apparatus includes a male connector (20) and a female connector (60), each having a bore (21, 61) extending therethrough, such that, when the male stab (25) of the male connector (20) and female receptacle (65) of the female connector (60) are engaged, a continuous passageway is formed, allowing flow of a fluid (e.g., pressurized hydraulic fluids, stimulation fluids, chemicals, wellbore fluids, water) through the connector apparatus (10). For example, a source of fluid, such as a fluid conduit (not shown), can be connected to the upper flange (56*b*) of the male connector (20), while a second fluid conduit or an item of subsea equipment (not shown) can be connected to the lower flange (87*a*) of the female connector (60), and the connector apparatus (10) can allow fluid communication therebetween when the male and female connectors (20, 60) engage, as shown in FIG. 1B. Specific elements of the depicted male and female connectors are shown in greater detail in the remaining FIGs. and described below.

Figure 2A:
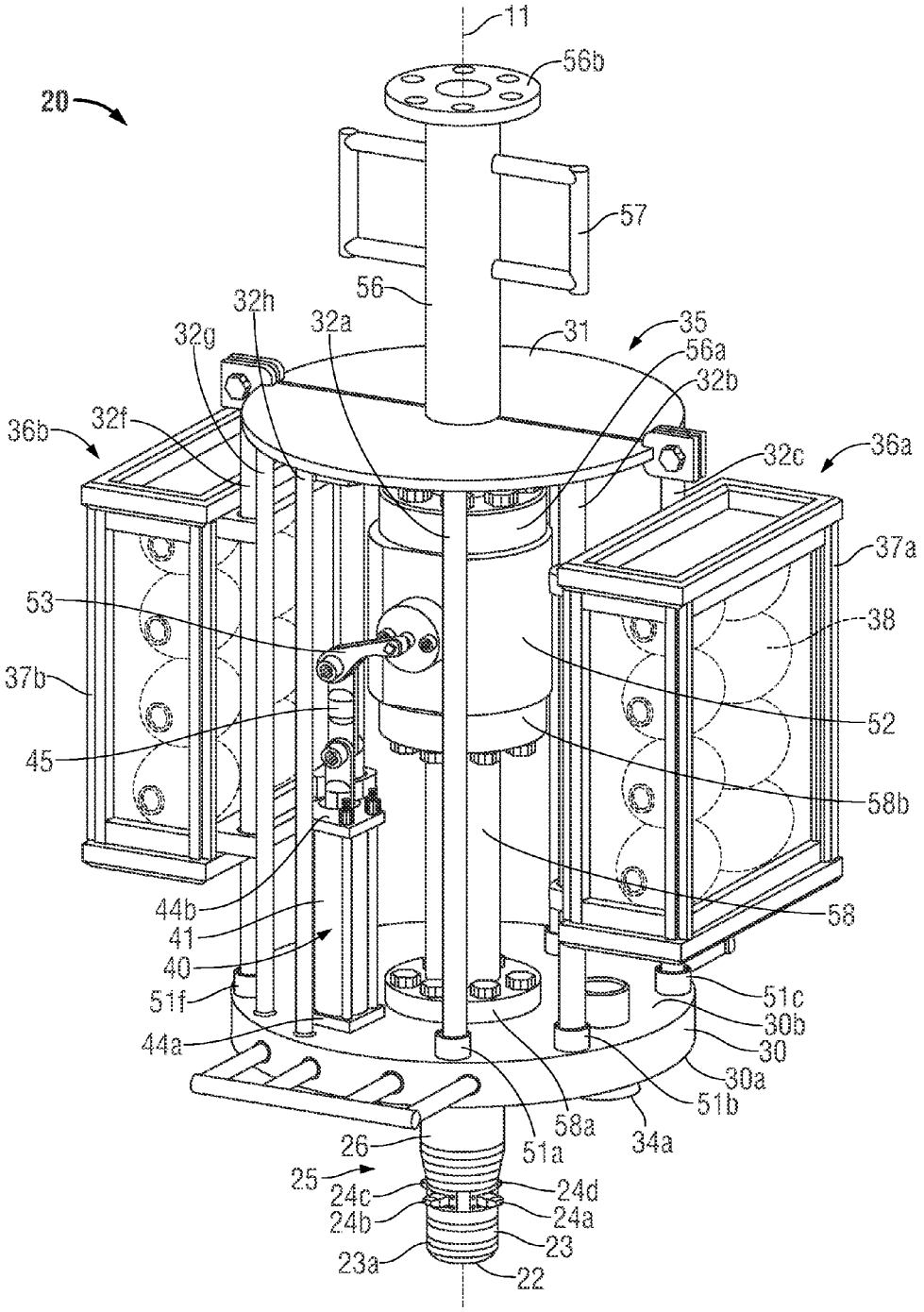
FIG. 2A depicts an isometric view of an embodiment of the male connector usable within the scope of the present disclosure.
Figure 2B:
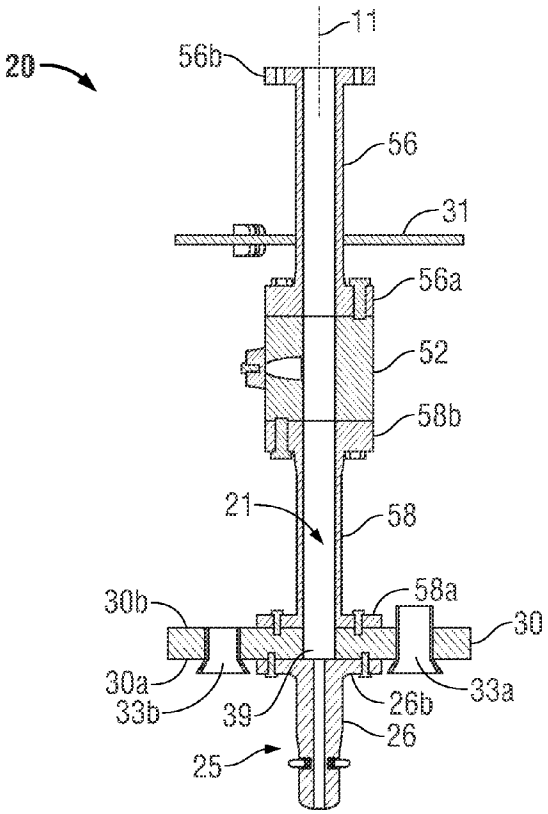
FIG. 2B depicts a cross-sectional side view of an embodiment of the male connector usable within the scope of the present disclosure.

Referring now to FIGS. 2A and 2B, an isometric view of an embodiment of the male connector (20), usable within the scope of the present disclosure, is shown. The male connector (20) is shown having a fluid passageway (21) (e.g., an axial bore) along the longitudinal axis (11) thereof and spanning the length of the male connector (20). As further depicted, the fluid passageway (21) extends the longitudinal length of the male connector (20), and through individual components forming the male connector (20). Specifically, the fluid passageway is defined by an upper extension (56), a ball valve (52), a lower extension (58), a base plate (30), and a stab section (25).

Referring again to FIG. 2A, the lower end of the male connector (20) comprises the stab section (25), which is adapted to lock with the female receptacle section (65, see FIG. 1A) of the female connector (60, see FIG. 1A). The embodiment of the male connector (20) depicts the stab section (25) comprising a generally cylindrical main body (26), four latches (24*a-d*), a sealing area (23), and a nose cone (22). In the course of engagement, the rounded nose cone (22) aids the insertion of the stab section (25) into the receptacle (60), through contact between the nose cone (22) and the internal surface of the receptacle (65). To prevent or reduce damage to the receptacle (65) upon insertion, the nose cone (22) can be constructed from a material that is softer than that the receptacle (65), including delrin or other plastics, bronze or other soft metals, or any other rigid material that is softer than the receptacle (65).

Figure 4:
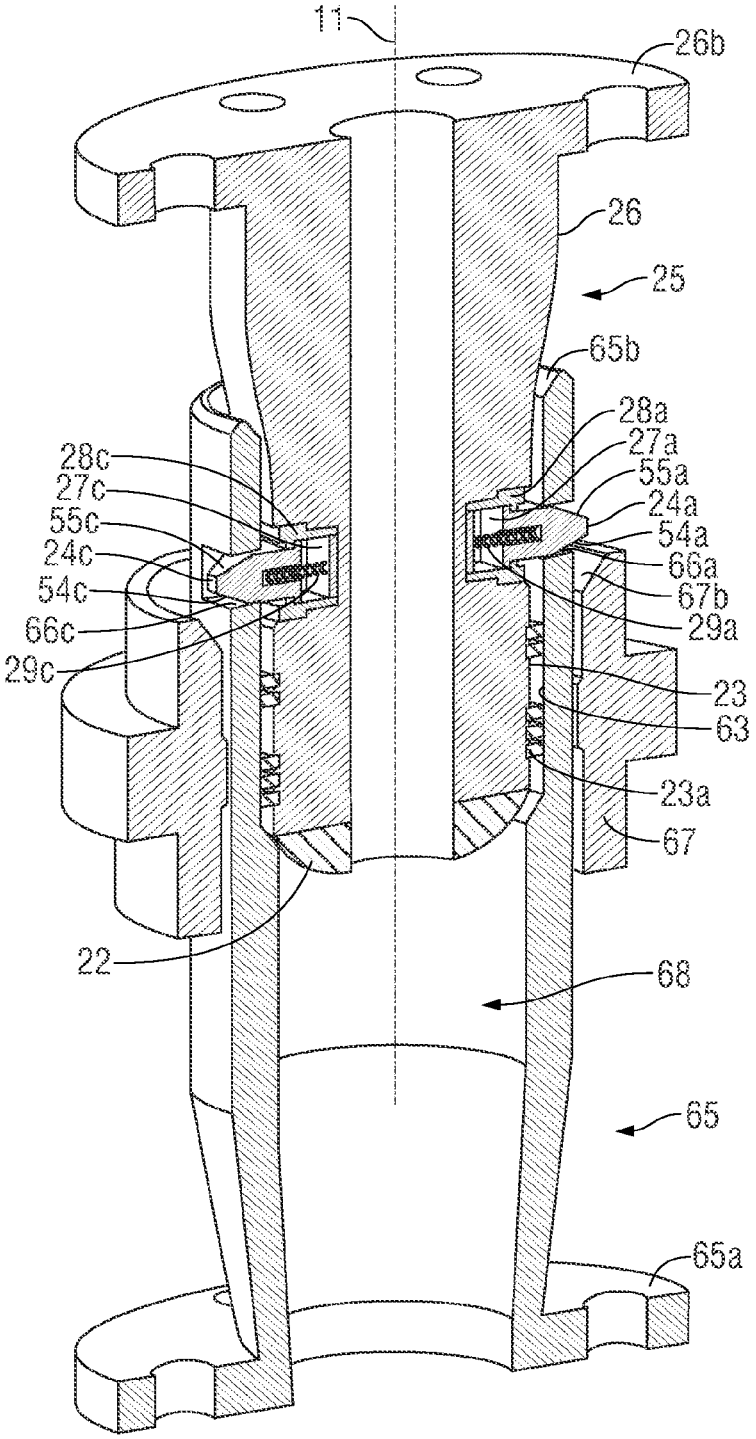
FIG. 4 depicts a cross-sectional close-up view of an embodiment of the engaged connector apparatus usable within the scope of the present disclosure.

Referring again to FIG. 2A and to FIG. 4, which depicts a close-up cross sectional view of an embodiment of the stab (25) and the receptacle (65), the external sealing area (23) of the male connector (25) forms a fluid seal against the internal sealing surface (63) of the receptacle (65). The sealing area (23) comprises a generally cylindrical configuration adapted for entry into the receptacle (65), resulting in engagement between the seal rings (23*a*) and the sealing surface (63). The depicted seal rings (23*a*) prevent fluids from breaching the connection between the stab (25) and the receptacle (65), when the sealing area (23) is engaged with a corresponding sealing surface (63). It should be understood that in alternate embodiments, the manner of creating a fluid seal can include any type, configuration, number, and/or combination of sealing elements, including elastomeric seals, O-rings, gaskets, metal or elastomeric rings, cup seals, metal-to-metal seals, and/or other types of sealing elements. The sealing members may also include one or more bidirectional or unidirectional sealing elements (not shown), such as cup seals, oriented in opposite directions. Such seal configurations can prevent fluid from breaching the seals during operations involving positive or above ambient internal fluid pressures. The described seal configurations can also prevent fluids from breaching the seals during operations involving vacuum pressures, or when communicating fluids at pressures that are below ambient fluid pressures.

As further depicted in FIGS. 2A and 4, the stab section (25) is shown comprising four protrusions, called latches (24*a-d*), extending radially outward from their respective cavities (27*a-d*, 27*b* & 27*d* not shown) extending into the stab body (26) adjacent to the sealing region (23). Specifically, FIG. 4B shows the latches (24*a*, 24*c*) being positioned within a latch housing (28*a*, 28*c*), and the lathes being extended therefrom by springs (29*a*, 29*c*) located within the latch housing (28*a*, 28*c*). As described below, in the course of the stab (25) connection and disconnection procedures, the latches (24*a*, 24*c*) can be retracted into respective cavities (27*a*, 27*c*), by pushing the latches (24*a*, 24*c*) inward with sufficient force to compress the springs (29*a*, 29*c*). It should be understood that while the present embodiment comprises four latches (24*a-d*) spaced equidistantly (i.e. 90 degrees apart) about the body (26) of the stab section (25), alternate embodiments (not shown), usable within the scope of the present disclosure, can include any number of latches spaced about the body (26) at any desired distances.

As further depicted in FIG. 4, the latches (24*a-d*, 24*b* and 24*d* not shown) comprise front sloped surfaces (54*a-d*, 54*b* and 54*d* not shown) and back sloped surfaces (55*a-d*, 55*b* and 55*d* not shown), which are shown oriented diagonally with respect to the longitudinal axis (11) and located on opposite sides of the latches (24*a-d*, 24*b* and 24*d* not shown). During connector (10) engagement procedures, the sloped surfaces (36*a-d*) can be used to transfer direction of a force, wherein lateral forces directed at the front and back sloped surfaces (54*a-d*, 55*a-d*, 54*b* and 54*d* not shown, 55*b* and 55*d* not shown) can be directed to compress the latches (24*a-d*), forcing them to retract into their respective cavities (27*a-d*, 27*b* and 27*d* not shown). Specifically, during stab connection operations, the latches (24*a-d*) can be retracted through lateral contact between the upper edge of the receptacle (65) and the front sloped surfaces (54*a-d*) of the latches (24*a-d*) and, during stab disconnection operations, between the upper edge of the sleeve (67) and the front sloped surfaces (54*a-d*, 54*b* and 54*d* not shown). As depicted in FIGS. 2B and 4, the upper end of the stab body (26) terminates with a flange (26*b*), which is connected to the lower face (30*a*) of a base plate (30).

Referring again to FIGS. 2A and 2B, the Figures depict the base plate (30) as a generally flat circular plate having a heavy-duty construction, which can be adapted to withstand large bending forces and to support additional components, such as the cage assembly (35) and the spring apparatus (40). The base plate (30) further comprises a central aperture (39) at its approximate center to define a portion of the fluid passageway (21). The depicted embodiment also includes three guide rod apertures (33*a-c*, 33*c* not shown) located around the central aperture (39) and extending through the base plate (30), between the upper and lower surfaces (36*b*, 36*a*). The depicted base plate (30) further comprises three conical guides (34*a-c*, 34*c* not shown) (e.g. pipe segments), shown in FIG. 2B, each positioned within a respective guide rod aperture (33*a-c*). The conical guides (34*a-c*, 34*c* not shown) comprise interior angled surfaces which contact the guide rods (71*a-c*, see FIG. 3A) of the female connector (60, see FIG. 3A) during engagement, as described below. The conical guides (34*a-c*, 34*c* not shown) capture the guide rods (71*a-c*) as the male connector (20) descends into the locking position with the female connector (60).

As further depicted in FIGS. 2A and 2B, the upper face (30*b*) of the base plate (30) connects with a lower flange (58*a*) of the lower extension pipe (58), wherein the upper flange (58*b*) of the lower extension pipe (58) is connected to a ball valve (52) usable to selectively shut off fluid flow through the fluid passageway (21) of the male connector (20). The ball valve (52) comprises a lever (53) usable to actuate the ball valve (52) between open and closed positions. Although FIGS. 2A and 2B depict a ball valve (52), it should be understood that in alternate embodiments (not shown) of the male connector (20), other flow control valves known in the industry, such as butterfly valves, gate valves, globe valves, or any other valves, may be used. As shown, the upper side (i.e. the opposite side) of the ball valve (52) is connected to the lower flange (56*a*) of the upper extension pipe (56), which can also comprise an upper flange (56*b*) adapted to form a fluid connection with an external fluid conduit (not shown). Although FIGS. 2A and 2B depict the upper and lower extension pipes (56, 58) comprising flange connections (56*a*, 56*b*, 58*a*, 58*b*), in alternate embodiments of the male connector (20) the extension pipes (56, 58) may comprise other connection types known in the industry, including male and/or female threads (not shown).

Figure 5:
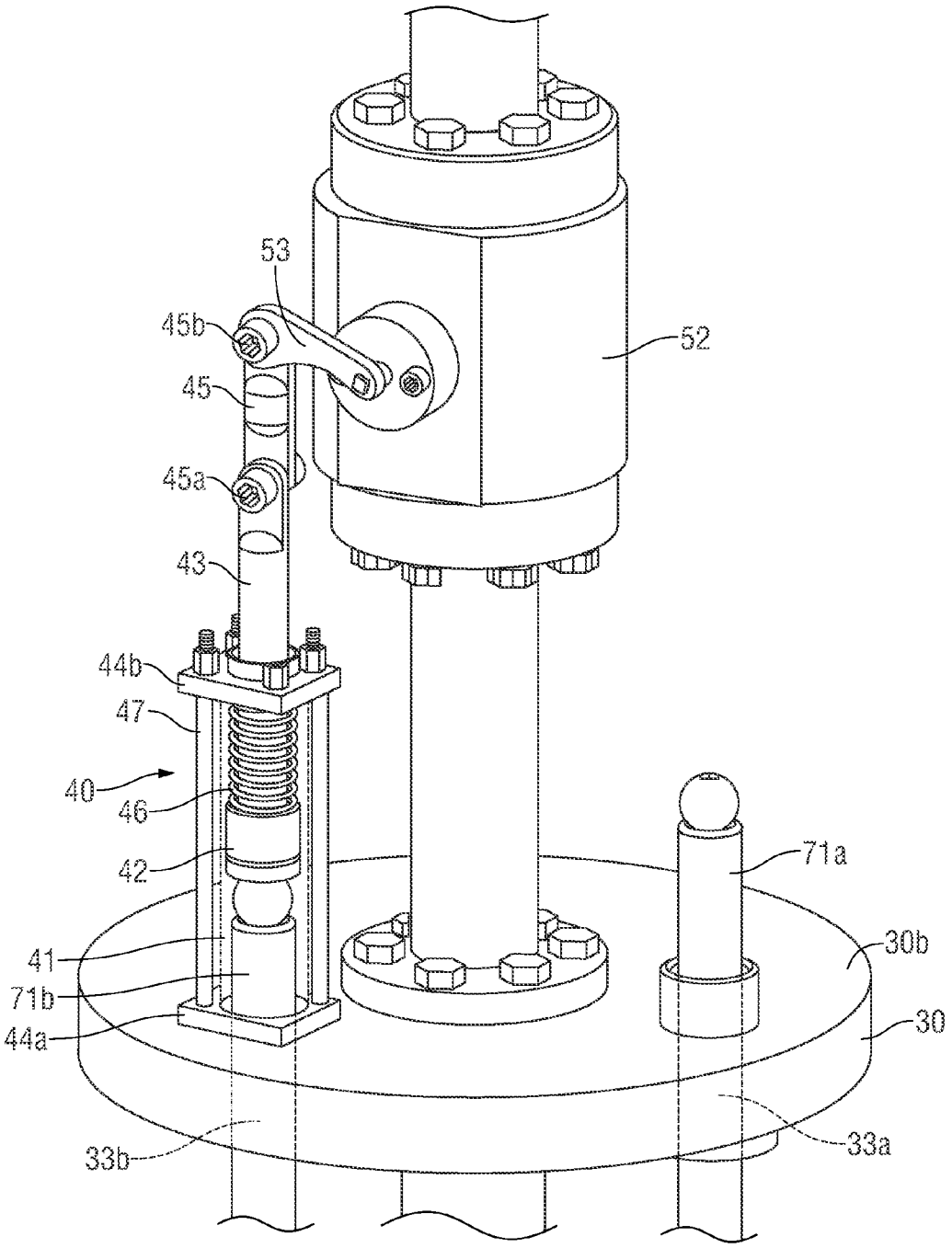
FIG. 5 depicts an isometric view of a portion of an embodiment of the male connector usable within the scope of the present disclosure.

The male connector (20), as depicted in FIGS. 2A and 5, comprises a spring apparatus (40) usable to actuate the ball valve (52) between open and closed positions. The depicted spring apparatus (40) comprises a tube (41) encompassing a piston (42), slidably positioned therein, wherein the piston (42) can be connected to a rod (43), which extends through an upper end cap (44*b*). The rod (43) can be connected to the ball valve lever (53) by an extension link (45), wherein the upper and lower ends of the extension link (45) forms pivotal connections between the lever (53) and the rod (43). As depicted in FIG. 5, the pivotal connections are formed by an upper bolt (45*b*), extending through the lever (53) and the upper end of the extension link (45), and by a lower bolt (45*a*), extending through the upper end of the rod (43) and the lower end of the extension link (45). As further depicted in FIG. 5, the piston (42) is biased in the retracted (i.e. downward) position by an internal spring (46) positioned within the tube (41) (shown as an outline for clarity) about the rod (43). The spring (46) extends between the upper end cap (44*b*) and the piston (42), forcing the piston (42) in the downward direction toward the lower end cap (44*a*). The lower end cap (44*a*) comprises a vertical hole extending therethrough and retains the piston (42) within the tube (41) against the force of the spring (46). In FIGS. 2A and 5 the spring apparatus (40) is shown biasing the ball valve (52) to a normally closed position. Specifically, the spring (46) maintains (i.e. forces) the piston (42) in a downward position, thereby forcing the rod (43) and the extension link (45) to pull the ball valve lever (53) to closed valve position.

FIGS. 2A and 5 depict the spring apparatus (40) being held together and connected to the upper face (30*b*) of the base plate (30) by four tie rods (47) directly over the guide rod aperture (33*b*) extending through the base plate (30). The aperture (33*b*) is adapted to receive a guide rod (71*b*, see FIG. 1A), which extends vertically from the female connector (60, see FIG. 1A). During connector (10) engagement procedures, as explained below, the guide rod (71*b*) extends through the guide rod aperture (33*b*), through the vertical hole in the lower end cap (44*a*), and into the tube (41), pushing the piston (42) in the upward direction, against the force of the spring (46).

As stated above and further depicted in FIG. 2A, the male connector (20) further comprises a base plate (30) supporting a cage assembly (35), which surrounds the ball valve (52) and the spring apparatus (40). The cage assembly (35) protects the ball valve (52) and the spring apparatus (40) from external tools or objects (not shown) making contact with and causing damage to these components. The depicted cage assembly (35) comprises an upper plate (31) and a plurality of bars (32*a-h*, 32*d-e* not shown) extending between the upper plate (31) and the base plate (30). The upper ends of the bars (32) can be welded to the upper plate (31) while the lower ends of the bars can be retained within complementary tubular extrusions (51*a-f*, 51*d-e* not shown) extending from the upper side (30*b*) of the base plate (30). Two of the bars (32*g*, 32*h*) are shown welded to the upper side (30*b*) of the base plate (30), thereby retaining the cage assembly (35) fixed to the base plate (30). In the embodiment of the male connector (20) depicted in FIG. 2A, the upper plate (31) is depicted having a circular shape and positioned about the upper extension pipe (56), above the lower flange (56*a*). The upper plate (31) is shown comprising two halves, adapted to be joined by bolts, enabling the cage assembly (35) to be assembled around the ball valve (52) and the spring apparatus (40), as described above. The ability to separate the upper plate (31), allows the cage assembly (35) to be installed or removed about the ball valve (52) and the spring apparatus (40) without disconnecting the extension pipes (56, 58). It should be understood that FIG. 2A depicts a single embodiment of the male connector (20) and that in alternate embodiments, the cage assembly (35) may comprise a different configuration without departing from the scope of the present disclosure. For example, the upper plate may be welded or otherwise attached directly to the upper extension pipe (56). In other embodiments (not shown), the rods (32) may be threadably connected to both the upper plate (31) and/or the base plate (30). In yet another embodiment (not shown), the plurality of rods (32) may include more or less than the eight rods (32*a-h*) in the embodiment depicted in FIG. 2A.

Referring again to FIG. 2A, the depicted male connector (20) further comprises two buoyancy modules (36*a*, 36*b*) usable to provide buoyancy to the male connector (20) or the connector assembly (10) when submerged in seawater. The buoyancy modules (36*a*, 36*b*) comprise an outer frame (37*a*, 37*b*) retaining a plurality of air canisters (38) therein. The air canisters (38) are adapted to be filled with seawater or evacuate seawater in order to adjust the buoyancy of the male connector (20) or the entire connector assembly (10) during operation. As further depicted in FIG. 2A, the buoyancy modules (36*a*, 36*b*) are connected to the cage assembly (35) by a plurality of clamps between the outer frame (37*a*, 37*b*) and the cage assembly (35). It should be understood that while FIG. 2A depicts a cage assembly (35) and buoyancy modules (36*a*, 36*b*), in other embodiments (not shown) of the male connector (20), all or any portion of the cage assembly (35) and/or the buoyancy modules (36*a*, 36*b*) can be omitted without departing from the scope of the present disclosure.

Figure 3A:
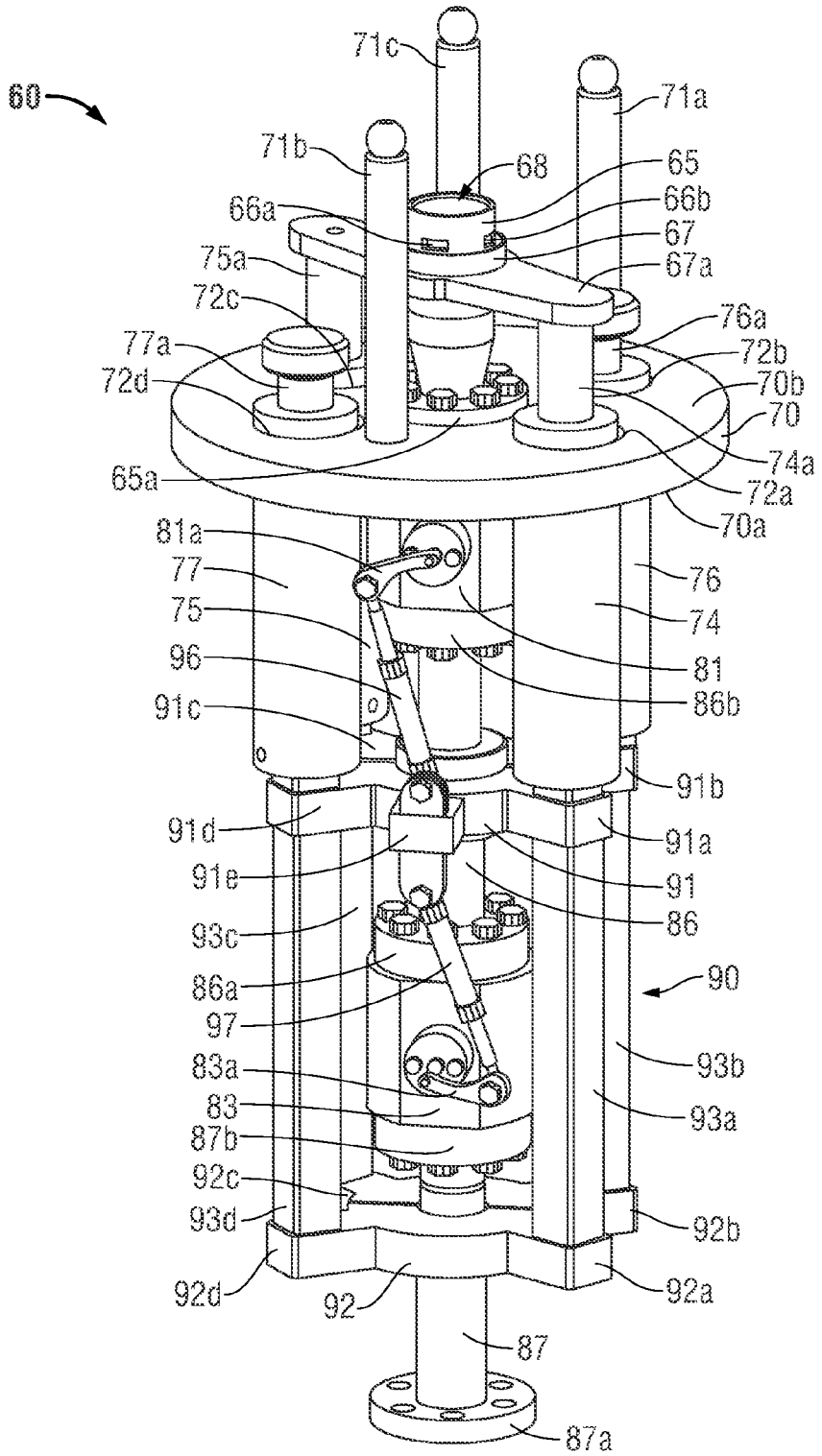
FIG. 3A depicts an isometric view of an embodiment of the female connector usable within the scope of the present disclosure.
Figure 3B:
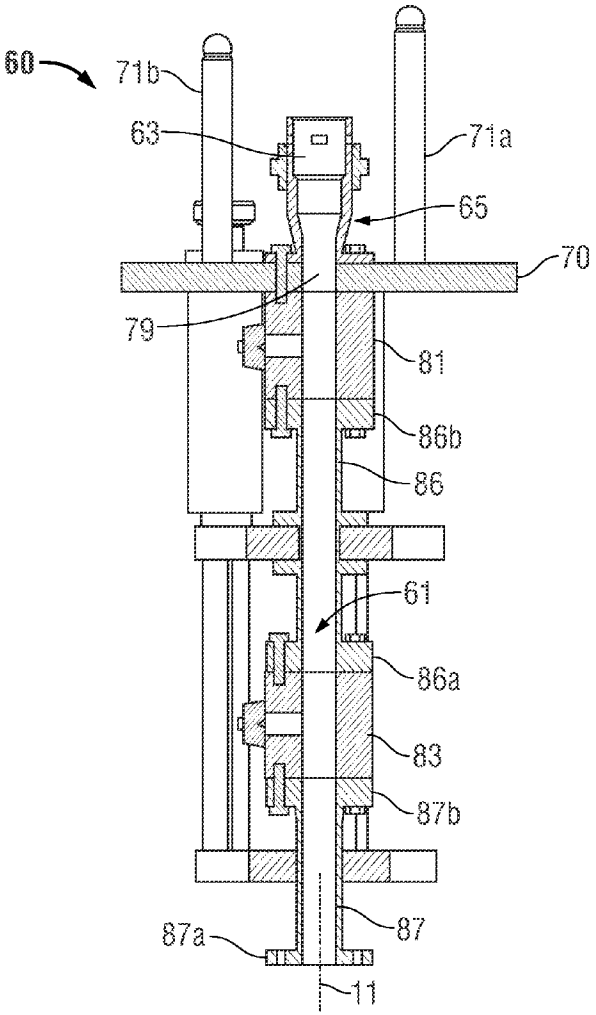
FIG. 3B depicts a cross-sectional side view of an embodiment of the female connector usable within the scope of the present disclosure.

Referring now to FIGS. 3A and 3B, an isometric view and a cross-sectional side view and of an embodiment of a female connector (60) usable within the scope of the present disclosure are shown. The female connector (60) is shown comprising several components connected inline to define a fluid passageway (61) extending along the longitudinal axis (11) thereof. The components forming the fluid passageway are the receptacle (65), the lower base plate (70), the upper ball valve (81), the upper extension pipe (86), the lower ball valve (83), and the lower extension pipe (87).

As shown in FIGS. 3A and 4 depicting the female connector (60), the uppermost component defining the fluid passageway is the receptacle (65). The receptacle (65) is shown having a generally cylindrical configuration and comprising a central cavity (68) extending therethrough along the central axis (11) thereof. The lower end of the receptacle comprises a flange (65*a*) configured to make a fluid connection with the upper surface (70*b*) of the lower base plate (70). In alternate embodiments of the female connector (60), the receptacle (65) may include any connection type between the receptacle (60) and lower base plate (70). For example, the lower end of the receptacle (65) may comprise a female thread, a male thread, other types of flanges, or any other means for establishing a fluid connection (not shown).

The receptacle (65) is further depicted comprising four rectangular apertures (66*a-d*, 66*c* and 66*d* not shown) extending laterally therethrough, adjacent to the upper end thereof, opposite the flange (65*a*). The apertures (66*a-d*) can be symmetrically spaced relative to each other and configured to receive the four latches (24*a-d*, 24*b* and 24*d* not shown) extending from the stab (25). The receptacle (65) can comprise a tapered or a cone shaped upper edge (65*b*), which can contact the latches (24*a-d*) during stab connection operations. The upper edge (65*b*) can lessen the friction between the receptacle (65) and the latches (24*a-d*), allowing the latches to retract into their cavities (27*a-d*, 27*b* and 27*d* not shown) with less required force. Furthermore, the upper portion of the internal surface of the receptacle (65), referred to as the internal sealing surface (63, shown in FIG. 4), can be adapted to receive the sealing section (23) of the stab (25). Specifically, when the stab (25) and the receptacle (65) are engaged, as depicted in FIG. 4, the sealing section (23) forms a fluid seal against the internal sealing surface (63). While the embodiment depicted in FIGS. 3A and 4 includes four apertures (66*a-d*, 66*d* not shown), which are generally equidistantly spaced about the receptacle (65), other embodiments (not shown), usable within the scope of the present disclosure, can include any number, shape, size, and/or configuration of receptacles adapted to accept the corresponding latches.

Referring again to the embodiments shown in FIGS. 3A and 4, the female connector (60) further comprises a sleeve (67) slidably positioned about the receptacle (65), wherein the sleeve has an inside diameter being sufficiently larger to allow the sleeve free movement about the receptacle. The sleeve (67) is shown comprising a generally tubular configuration having a tapered or a cone shaped upper edge (67*b*), adapted to contact the latches (24*a-d*, 24*b* and 24*c* not shown in FIG. 4), and a bracket member (67*a*), extending laterally therefrom, adapted to connect the sleeve (67) to the piston rods (74*a*, 75*a*) of the unlocking hydraulic cylinders (74, 75). As depicted in FIG. 3A, the upper ends of the unlocking cylinders (74, 75) protrude through the lower base plate (70), wherein the unlocking cylinders (74, 75) are positioned on opposite sides of the receptacle (65) and in a generally parallel configuration with respect to the receptacle (65). Although FIG. 3A depicts the sleeve (67) being connected to two hydraulic cylinders (74, 75), the sleeve (67) can be moved about the receptacle (65) by any number of hydraulic cylinders or by other mechanical actuators (not shown). As further depicted in FIGS. 3A and 3B, the lower end of the receptacle (65) terminates with a flange (65*a*), which is connected to the upper face (70*b*) of a lower base plate (70). The flange (65*a*) is shown bolted to the lower base plate (70), being positioned concentrically about a central aperture (79, see FIG. 3B) at the center of the lower base plate (70).

FIG. 3A also depicts the lower base plate (70) as a generally flat circular plate having a heavy-duty construction adapted to withstand large bending forces transmitted thereto by three guide rods (71*a-c*) extending therefrom. The depicted guide rods (71*a-c*) are positioned around the receptacle (65) and configured to enter the corresponding apertures (33*a-c*, 33*c* not shown) extending through the base plate (30), as depicted in FIGS. 1A and 1B. As further shown in FIGS. 1A and 1B, each guide rod (71*a-c*) is shown having a generally cylindrical shape with a rounded upper end, which can contact the angled interior surface of a respective conical guide (34*a-c*, 34*c* not shown) of the male connector (20), such that each guide rod (71*a-c*) is inserted into a respective conical guide (34*a-c*) of the base plate (30), thereby allowing proper engagement of the connector assembly (10). During connector assembly (10) engagement and disengagement procedures, the guide rods (71*a-c*) maintain the male connector (20) in proper alignment for engagement with the female connector (60).

Once the connector assembly (10) is in the engaged position, as depicted in FIG. 1B, the guide rods (71*a-c*) can reinforce the integrity of the connection between the male (20) and the female (60) connectors. Specifically, the guide rods (71*a-c*) can prevent and/or minimize the bending forces, between the male (20) and female (60) connectors, from being transferred to the stab section (25) and the receptacle (65). In the connector assembly (10 depicted in FIG. 1B), a portion of the external bending forces, between the male (20) and female (60) connectors, supported by the guide rods (71*a-c*), the base plate (30), and the lower base plate (70), can maintain proper alignment between the stab section (25) and the receptacle (65) and can prevent damage thereto. Maintaining the stab section (25) and the receptacle (65) oriented in a straight and/or linear relationship relative to one another enables the formation of a proper fluid seal therebetween. Proper orientation of the sealing area (23) and the sealing surface (63), both shown in FIG. 4, can prevent fluids from breaching the connector.

FIG. 3A also depicts the lower base plate (70) having four additional apertures (72*a-d*) extending vertically therethrough and spaced around the receptacle (65). Two of the apertures (72*a*, 72*c*) are adapted to receive the unlocking hydraulic cylinders (74, 75) extending therethrough, while the other two apertures (72*b*, 72*d*) are adapted to receive the separation hydraulic cylinders (76, 77) extending therethrough. As depicted in FIGS. 1A and 3A, the separation hydraulic cylinders (76, 77) comprise piston rods (76*a*, 77*a*), adapted to contact the base plate (30) and to push the male connector (20) away from the female connector (60) until the guide rods (71*a-c*) exit the guide rod apertures (33*a-c*, 33*c* not shown) and the male connector (20) is fully disengaged from the female connector (60). In alternate embodiments (not shown) of the female connector (60), the upper ends of the hydraulic cylinders (74, 75, 76, 77) may be threaded directly into the lower base plate (70), mounted to the lower base plate (70) with a cylinder flange, or attached to the lower base plate by any means known in the industry.

As further depicted in FIGS. 3A and 3B, the lower face (70*a*) of the lower base plate (70) is connected to the upper side of the upper ball valve (81) usable to selectively allow or shut off fluid flow through the fluid passageway (61) of the female connector (60). The upper ball valve (81) comprises a lever (81*a*) usable to shift the upper ball valve (81) between the open and closed positions. As shown, the lower side of the upper ball valve (81) is connected to the upper flange (86*b*) of the upper extension pipe (86), which can also comprise a lower flange (86*a*), connected with the upper side of the lower ball valve (83). The depicted lower ball valve (83) can comprise a lever (83*a*) that can be usable to shift the lower ball valve (83) between the open and closed positions. The lower side of the lower ball valve (83) is shown connected to the upper flange (87*b*) of the lower extension pipe (87), which can also comprise a lower flange (87*a*) that can be adapted to form a fluid connection with an external fluid conduit (not shown). Although FIGS. 3A and 3B depict the upper and lower extension pipes (86, 87) comprising flange connections (86*a*, 86*b*, 87*a*, 87*b*), in alternate embodiments of the female connector (60), the extension pipes (86, 87) may comprise other connection types known in the industry, including male and/or female threads (not shown). Lastly, although FIGS. 3A and 3B depict ball valves (81, 82), it should be understood that in alternate embodiments (not shown) of the female connector (60), other flow control or flow shutoff valves known in the industry, such as butterfly valves, gate valves, globe valves, or any other valves, may be used.

As further depicted in FIG. 3A, the female connector (60) further comprises a support assembly (90), which maintains in position two shut-off hydraulic cylinders (96, 97), two unlocking hydraulic cylinders (74, 75), and two separation hydraulic cylinders (76, 77). The support assembly (90) also partially surrounds the lower ball valve (83) and the lower shut-off cylinder (97), and protects the lower ball valve (83) and the lower shut-off cylinder (97) from external tools or objects (not shown) making contact with, and causing damage to, these components.

The embodiment of the female connector, shown if FIG. 3A, also depicts a support assembly (90) for supporting hydraulic cylinders (74, 75, 76, 77, 96, 97). The depicted support assembly (90) comprises an upper bracket (91), a lower bracket (92), and four vertical bars (93*a-d*) extending therebetween. Specifically, the upper bracket (91) is depicted comprising a circular central aperture, four rectangular apertures (91*a-d*) extending vertically therethrough, and a rectangular protrusion (91*e*) extending laterally therefrom. The upper bracket (91) splits into two halves, which can be bolted together about the upper extension pipe (86) between the upper and lower ball valves (81, 83). FIG. 3A shows the four apertures (91*a-d*) supporting the four vertical bars (93*a-d*) extending therethrough. The upper ends of two of the vertical bars (93*a*, 93*c*) are connected to the lower ends of the unlocking cylinders (74, 75), maintaining the unlocking cylinders (74, 75) in a vertical position extending through corresponding apertures (72*a*, 72*c*) in the lower base plate (70). The upper ends of the two remaining vertical bars (93*b*, 93*d*) are connected to the separation cylinders (76, 77), maintaining the cylinders (76, 77) in a vertical position extending through corresponding apertures (72*b*, 72*d*) in the lower base plate (70). The protrusion (91*e*) contains a clevis mount on the top and bottom side thereof, wherein the upper clevis mount pivotally connects to the upper shut off cylinder (96) and lower clevis mount pivotally connects to the lower shut off cylinder (97). The fifth protrusion provides support to the upper and lower shut off cylinders, enabling the cylinders to actuate the upper and lower ball valves (81, 83).

As depicted in FIG. 3A, the support assembly (90) further comprises a lower bracket (92) having a central aperture and four rectangular cavities (92*a-d*) extending vertically therein. The lower bracket (91) splits into two halves, which can be bolted together about the lower extension pipe (87) below the lower ball valve (83). FIG. 3A shows the four cavities (92*a-d*) supporting four vertical bars (93*a-d*) positioned therein, preventing the vertical bars (93*a-d*), from moving horizontally or vertically.

In order to actuate the hydraulic cylinders (74, 75, 76, 77, 96, 97) depicted in FIG. 3A, the female connector (60) also requires a plurality of fluid fittings (not shown) and fluid hoses (not shown) to deliver and evacuate pressurized fluids to and from said hydraulic cylinders. Although these fittings and hoses are not shown, such fluid connectors and conduits are known in the industry, and are included within the scope of the present disclosure.

Embodiments usable within the scope of the present disclosure also relate to methods of connecting subsea fluid conduits. Referring again to FIG. 1A, a side view of an embodiment of the connector apparatus (10) is shown. Specifically, the Figure depicts the male connector (20), which can be attached to an upper fluid conduit (not shown) via the upper flange (56*b*), being lowered toward engagement with the female connector (60), which can be attached to a lower fluid conduit or an item of well equipment (not shown). A ROV or a diver can maneuver or guide the male connector (20) during this process by gripping the handles (57). As the male connector (20) nears the female connector (60), the upper ends of the guiding rods (71*a-c*) can contact the conical guides (34*a-c*, 34*c* not shown) of the male connector (20), such that the male connector (20) can be oriented into proper alignment for engagement with the female connector (60). When the guide rods (71*a-c*) enter the corresponding guide rod apertures (33*a-c*, 33*c* not shown), the male connector (20) can be properly aligned with the female connector (60), enabling the stab (25) to mate with the receptacle (65).

Referring now to FIG. 5, as the second guide rod (71*b*) moves through the second guide rod aperture (33*b*), the upper end of the guide rod (71*b*) enters the tube (41) of the spring apparatus (40). The guide rod (71*b*) pushes against the lower end of the piston (42), lifting the piston upwards against the force of the spring (46). As the piston (42) moves upwards within the tube (41), it pushes the rod (43) and the extension link (45) upwards, rotating the lever (53) and actuating the flow control valve (52) to the open position.

Referring again to FIG. 4, the Figure depicts a cross-sectional close-up view of the stab (25) and the receptacle (65) in an engaged position. As the male connector (20) further approaches the female connector (60), the stab (25) enters the receptacle (65), wherein the nose cone (22), shown in FIGS. 1A and 4, helps in guiding the stab (25) into the receptacle (65). Specifically, as the stab (25) enters the receptacle (65), the nose cone (22) can make contact with the upper edge (65*b*) and/or the internal sealing surface (63) of the receptacle (65), guiding the stab (25) into proper alignment with the receptacle (65). Once the nose cone (22) is inserted into the receptacle (65), the stab (25) is lowered until the front sloped surfaces (54*a-d*, 54*b* and 54*d* not shown) of the latches (24*a-d*, 24*b* and 24*d* not shown) contact the cone-shaped upper edge (65*b*) of the receptacle (65).

Moving the stab (25) further into the receptacle (65), causes the cone-shaped upper edge (65*b*) to force the latches (24*a-d*) to retract into their respective receptacles (27*a-d*, 27*b* and 27*d* not shown), overcoming the force of the springs (29*a-d*, 29*b* and 29*d* not shown). As the latches (24*a-d*) move further down within the receptacle (65), they become aligned with the rectangular apertures (66*a-d*, 66*b* and 66*d* not shown) and extend therethrough, locking the stab (25) within the receptacle (65). FIGS. 1B and 4 show the latches (24*a-d*) extending through the apertures (66*a-d*), thereby preventing disconnection between the stab (25) and the receptacle (65). Once the stab (25) fully engages the receptacle (65), the sealing section (23) seals against the internal sealing surface (63) and prevents fluids from breaching the connector assembly (10).

Furthermore, during the course of engagement between the male and the female connectors (20, 60), or following full engagement depicted in FIG. 1B, both shut-off hydraulic cylinders (96, 97) can be powered by external hydraulics (not shown) to actuate the upper and the lower ball valves (81, 83) to the open position. At this point, the male connector (20) and the female connector (60) are fully engaged, the ball valves (52, 81, 83) are shifted to the open positions, and fluids can be communicated through the connector assembly (10).

Embodiments usable within the scope of the present disclosure also relate to methods for terminating a fluid connection with a fluid connector assembly (10). During the course of operations or in the event of an emergency that requires disconnection, the male and female connectors (20, 60) can be quickly disengaged. Referring again to FIGS. 1B and 4, an isometric view and a cross-sectional close-up view of an embodiment of the connector assembly (10) in the engaged position, is shown. In order to disengage the stab (25) from the receptacle (65), the latches (24*a-d*, 24*b* and 24*d* not shown) are retracted into their respective cavities (27*a-d*, 27*b* and 27*d* not shown) by the sleeve (67). During disengagement, the sleeve (67) can be moved upwards against the latches (24*a-d*) by extending both unlocking hydraulic cylinders (74, 75) using external hydraulics (not shown). As the sleeve (67) moves in the upward direction, the cone-shaped upper edge (67*b*) can come into contact with the front sloped surfaces (54*a-d*, 54*b* and 54*c* not shown) of the latches (24*a-d*), forcing the latches (24*a-d*) to retract into their respective receptacles (27*a-d*) against the force of the springs (29*a-d*). The cone-shaped or inwardly sloping front edge (67*b*) of the sleeve (67) and the front sloping surfaces (54*a-d*) of the latches (24*a-d*) can enable the sleeve (67) to force the latches (24*a-d*) into their respective cavities (27*a-d*) with lesser-required force. Once the sleeve (67) fully covers the rectangular apertures (66*a-d*, 66*b* and 66*d* not shown), the latches (24*a-d*) are sufficiently retracted to allow the stab (25) to be pulled out and fully disconnected from the receptacle (65). Specifically, as the stab (25) is pulled from the receptacle (65), the latches (24*a-d*) are forced to retract further into the cavities (27*a-d*), by the walls of the rectangular apertures (66*a-d*), until they are fully retracted therefrom.

In order to fully separate the male connector (20) from the female connector (60), as depicted in FIGS. 1A and 3A, the separation cylinders (76, 77) can be powered by external hydraulics (not shown) and moved against the male connector (20) to facilitate the separation. Specifically, the separation hydraulic cylinders (76, 77) can extend their rods (76*a*, 77*a*) against the base plate (30) to push the male connector (20) away from the female connector (60), thus separating them. The separation cylinders (76, 77) can be configured to have a stroke of sufficient length to push the male connector (20) beyond the guide rods (71*a-c*), such that the guide rods can be disengaged from the corresponding guide rod apertures (33*a-c*, 33*c* not shown). At this point, the male connector (20) can be moved as desired, independent of the female connector (60), through use of a ROV, a diver, or by other means.

In addition, during separation, as the second guide rod (71*b*) is being retracted from the second guide rod aperture (33*b*), the ball valve (52) of the male connector (20) can be simultaneously actuated to the closed position. Specifically, as the second guide rod (71*b*) is retracted from the spring apparatus (40), depicted in FIG. 5, the piston (42) is free to move in the downward direction under the force of the spring (46). As the piston (42) is forced downwards, the rod (43) and the extension link (45) pull on the lever (53), actuating the ball valve (52) to the closed position, thereby cutting off fluid flow through the male connector (20) and preventing fluids in the upper conduit (not shown) from spilling into the water after disconnection Furthermore, prior to separation of the male (20) and the female connector (65), both shut-off hydraulic cylinders (96, 97), depicted in FIG. 3A, can be powered by external hydraulics (not shown) to actuate the upper and the lower ball valves (81, 83) to the closed position, thus cutting off fluid flow through the female connector (60) and preventing fluids in the lower conduit (not shown) from spilling into the water after disconnection. Once the ball valves (52, 81, 83) are closed and the fluids within the upper and lower conduits are trapped therein, the male and female connectors (20, 60) can be safely separated.

Various embodiments, usable within the scope of the present disclosure, have been described with emphasis and these embodiments can be practiced separately or in various combinations thereof. In addition, it should be understood that within the scope of the appended claims, the present invention can be practiced other than as specifically described herein.

What is claimed is:

1. A system for connecting subsea fluid conduits, the system comprising:

a first connector having an elongate body and an axial bore extending therethrough; and a second connector having an elongate body and an axial bore extending therethrough, wherein the first connector and the second connector are adapted to engage, wherein engagement between the first connector and the second connector joins the axial bore of the first connector with the axial bore of the second connector to define a flowpath for communicating a medium, wherein the first connector further comprises a flow control valve adapted to selectively open and close the axial bore of the first connector, and an actuating apparatus located external to the flowpath and comprising a spring connected to a rod and a lever operably connected to the rod to bias the flow control valve to a closed position, wherein the second connector is adapted to push the rod towards a first position and thereby actuate the flow control valve to an open position as the first connector and the second connector engage, and wherein the spring biases the rod towards a second position and thereby actuates the flow control valve to the closed position as the first connector and the second connector disengage.

2. The system of claim 1, wherein the second connector comprises an elongate protrusion extending therefrom, and wherein the elongate protrusion is adapted to actuate the flow control valve to the open position.

3. A system for connecting subsea fluid conduits, the system comprising:

a first connector having an elongate body and an axial bore extending therethrough; and a second connector having an elongate body and an axial bore extending therethrough, wherein the first connector and the second connector are adapted to engage, wherein engagement between the first connector and the second connector joins the axial bore of the first connector with the axial bore of the second connector to define a flowpath for communicating a fluid, wherein the first connector comprises a male stab having a generally cylindrical body and a plurality of retractable protrusions extending laterally therefrom, a flow control valve adapted to selectively open and close the axial bore of the first connector and an actuating apparatus located external to the flowpath and comprising a biasing member and a lever operably connected to bias the flow control valve to a closed position, wherein the second connector comprises a female receptacle having a generally cylindrical configuration and a plurality of apertures extending laterally therethrough, and at least one flow control valve adapted to selectively open and close the axial bore of the second connector, and wherein the male stab is adapted to insert into the female receptacle and the plurality of retractable protrusions into the plurality of apertures as the first connector and the second connector engage, and wherein the flow control valve of the first connector is adapted to actuate to the closed position and the at least one flow control valve of the second connector is adapted to actuate to close the axial bore of the second connector as the first connector and the second connector disengage.

4. The system of claim 3, wherein the at least one flow control valve of the second connector comprises two flow control valves connected in line.

5. The system of claim 3, wherein the flow control valve of the first connector is adapted to be actuated to an open position by the second connector as the first connector and the second connector engage.

6. The system of claim 5, wherein the flow control valve of the first connector and the at least one flow control valve of the second connector are adapted to automatically close as the first connector and the second connector disengage.

7. The system of claim 6, wherein the at least one flow control valve of the second connector is adapted to be actuated to the closed position by a fluid actuator.

8. The system of claim 3, wherein the second connector further comprises a sleeve slidably positioned about the receptacle, wherein the sleeve is adapted to retract the protrusions, thereby allowing the first connector and the second connector to disengage.

9. A method for establishing and terminating a fluid connection with a fluid connector assembly, the method comprising the steps of:

engaging a first connector with a second connector, thereby joining an axial bore of the first connector with an axial bore of the second connector to define a flowpath for communicating a fluid; and disengaging the first connector from the second connector comprising the steps of:

unlocking the first connector from the second connector;

retracting a male stab of the first connector from a female receptacle of the second connector;

disengaging the second connector from a flow control valve positioned within the first connector; and closing the flow control valve positioned within the first connector by allowing a biasing member to actuate a lever external to the flowpath to a closed position with a rod operably connecting the biasing member to the lever.

10. The method of claim 9, wherein the step of disengaging the first connector from the second connector further comprises the step of closing a flow control valve positioned within the second connector.

11. The method of claim 9, wherein the step of disengaging the second connector from the flow control valve positioned within the first connector comprises the steps of:

moving the first connector and the second connector away from each other;

retracting a protrusion extending from the second connector from the lever actuating the flow control valve positioned within the first connector.

12. The method of claim 9, wherein the step of unlocking the first connector from the second connector comprises the steps of retracting a plurality of protrusions extending laterally from a cylindrical body of the male stab from a plurality of apertures extending laterally through the female receptacle.

13. The method of claim 12, further comprising sliding a sleeve about the plurality of protrusions.

14. The method of claim 9, wherein the step of engaging a first connector with a second connector comprises the steps of:

moving the first connector and the second connector towards each other;

actuating the flow control valve positioned within the first connector to an open position with the second connector; and locking the first connector with the second connector, thereby joining the axial bore of the first connector with the axial bore of the second connector to define the flowpath for communicating the fluid.

* * * * *